US011280156B2

(12) United States Patent
Hess et al.

(10) Patent No.: US 11,280,156 B2
(45) **Date of Patent: *Mar. 22, 2022**

(54) METHOD FOR SLIM HOLE SINGLE TRIP REMEDIAL OR PLUG AND ABANDONMENT CEMENT BARRIER

(71) Applicant: Landmark Graphics Corporation, Houston, TX (US)

(72) Inventors: Joseph Eli Hess, Richmond, TX (US); Bruce Wallace Techentien, Houston, TX (US); Andy John Cuthbert, Spring, TX (US); Keith David Romaine, Sugarland, TX (US)

(73) Assignee: Landmark Graphics Corporation, Houston, TX (US)

( * ) Notice: Subject to any disclaimer, the term of this patent is extended or adjusted under 35 U.S.C. 154(b) by 41 days.

This patent is subject to a terminal disclaimer.

(21) Appl. No.: 16/841,283

(22) Filed: Apr. 6, 2020

(65) Prior Publication Data

US 2020/0232300 A1 Jul. 23, 2020

Related U.S. Application Data

(62) Division of application No. 15/549,977, filed as application No. PCT/US2016/043383 on Jul. 21, 2016, now Pat. No. 10,612,343.

(51) Int. Cl.

| | |
|---|---|
| ***E21B 33/14*** | (2006.01) |
| ***E21B 43/116*** | (2006.01) |
| ***E21B 23/06*** | (2006.01) |
| ***E21B 33/12*** | (2006.01) |
| ***E21B 43/117*** | (2006.01) |
| ***E21B 33/16*** | (2006.01) |
| ***E21B 43/04*** | (2006.01) |

(52) U.S. Cl.

CPC ..... *E21B 33/146* (2013.01); *E21B 23/06* (2013.01); *E21B 33/12* (2013.01); *E21B 33/16* (2013.01); *E21B 43/045* (2013.01); *E21B 43/116* (2013.01); *E21B 43/117* (2013.01)

(58) Field of Classification Search

CPC ..... E21B 23/06; E21B 33/12; E21B 33/146; E21B 33/16; E21B 33/165; E21B 43/045; E21B 43/116; E21B 43/117

See application file for complete search history.

(56) References Cited

U.S. PATENT DOCUMENTS

| | | | | |
|---|---|---|---|---|
| 3,195,633 | A | 7/1965 | Jacob | |
| 4,241,787 | A | 12/1980 | Price | |
| 4,372,384 | A * | 2/1983 | Kinney | E21B 43/119 166/278 |
| 5,174,379 | A | 12/1992 | Whiteley et al. | |
| 6,131,662 | A | 10/2000 | Ross | |
| 6,286,598 | B1 | 9/2001 | van Petegem et al. | |
| 6,330,913 | B1 | 12/2001 | Langseth et al. | |

(Continued)

*Primary Examiner* — Catherine Loikith

(74) *Attorney, Agent, or Firm* — Thomas Rooney; Parker Justiss, P.C.

(57) ABSTRACT

A new tool and methodology to work, in a single-trip system, and create conduits through the casing or tubing to access the annuli, circulate out the annuli contents, accurately deliver the cement required to create the subsequent barrier. The tool and system provide a cost effective way of plugging an oil and gas well in a single trip without the need to remove in-place production casing.

14 Claims, 5 Drawing Sheets

(56) References Cited

U.S. PATENT DOCUMENTS

| | | | |
|---|---|---|---|
| 6,382,315 | B1 | 5/2002 | Langseth |
| 6,494,260 | B2 | 12/2002 | Van Petegem et al. |
| 8,496,055 | B2 | 7/2013 | Mootoo et al. |
| 2002/0020535 | A1 | 2/2002 | Johnson et al. |

* cited by examiner

METHOD FOR SLIM HOLE SINGLE TRIP REMEDIAL OR PLUG AND ABANDONMENT CEMENT BARRIER

CROSS-REFERENCE TO RELATED APPLICATION

This application is a divisional of U.S. application Ser. No. 15/549,977 filed on Aug. 9, 2017, entitled "METHOD FOR SLIM HOLE SINGLE TRIP REMEDIAL OR PLUG AND ABANDONMENT CEMENT BARRIER" which is the National Stage of, and therefore claims the benefit of, International Application No. PCT/US2016/043383 filed on Jul. 21, 2016, entitled "METHOD FOR SLIM HOLE SINGLE TRIP REMEDIAL OR PLUG AND ABANDONMENT CEMENT BARRIER," both of which are commonly assigned with this application and are incorporated herein by reference in their entirety.

BACKGROUND

Modern regulatory standards in all US jurisdictions require specific provisions for plugging oil and natural gas wells before they are abandoned. A well is plugged typically by setting mechanical or cement plugs in the wellbore at specific intervals to prevent fluid flow. The plugging process usually requires a workover rig and cement pumped into the wellbore and water-based slurries of cement are typically the basic materials used to plug most wells.

The plugging and abandoning (P&A) of oil and gas wells that are no longer economically viable for production, or which have wellbore issues that require closure, remains a typical, but costly, practice in the oil and gas production business. Production wells that are no longer economical to operate must be plugged to prevent the oil and gas reservoir fluids or saltwater from migrating uphole over time and possibly contaminating other formations and or fresh water aquifers.

However, P&A continues to be even more important, not only to meet Federal and State environmental regulations but also because of new recovery techniques. As older oil and gas fields are re-entered to exploit bypassed reserves or to develop reserves deemed uneconomical in the past, the plugged and abandoned wells within the fields become a potential problem as new technologies are applied. These new recovery techniques can increase the reservoir pressure due to the injection of fluids for oil recovery. When this higher pressure is applied to unplugged or poorly plugged wells, there is a chance that the formation fluids will bypass the plugging materials and migrate uphole. This can cause problems with the fresh water aquifers in the area by allowing gas, oil or salt water to contaminate the fresh water.

BRIEF DESCRIPTION

Figure 1:
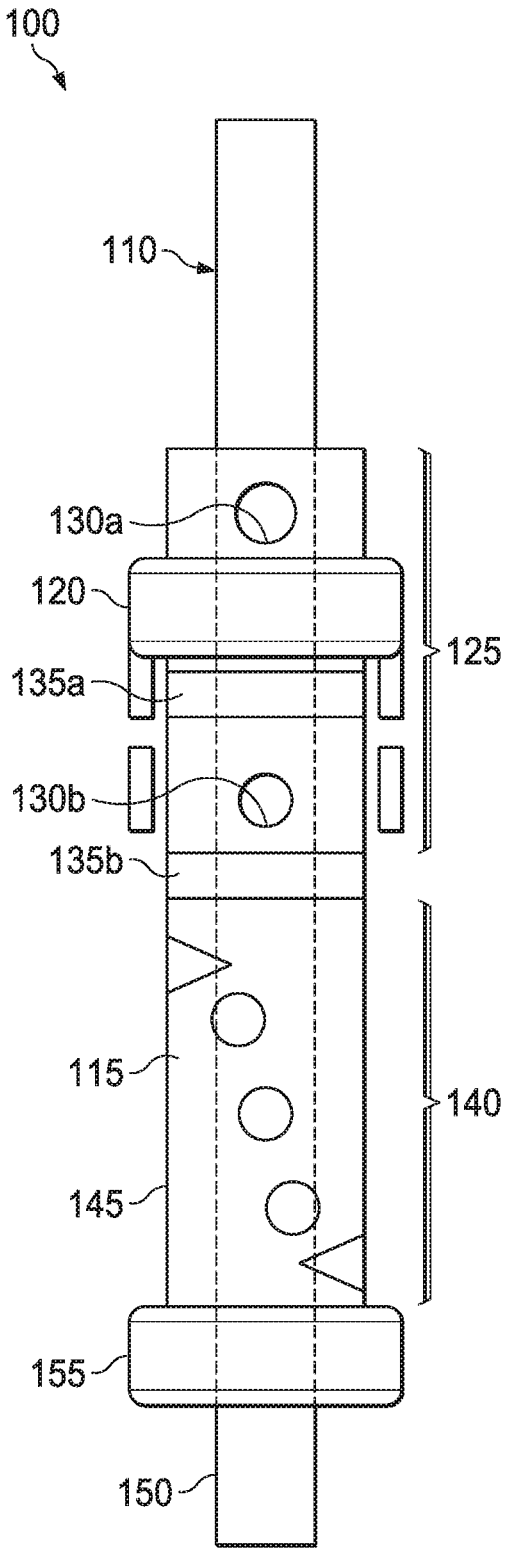
Figure 2B:
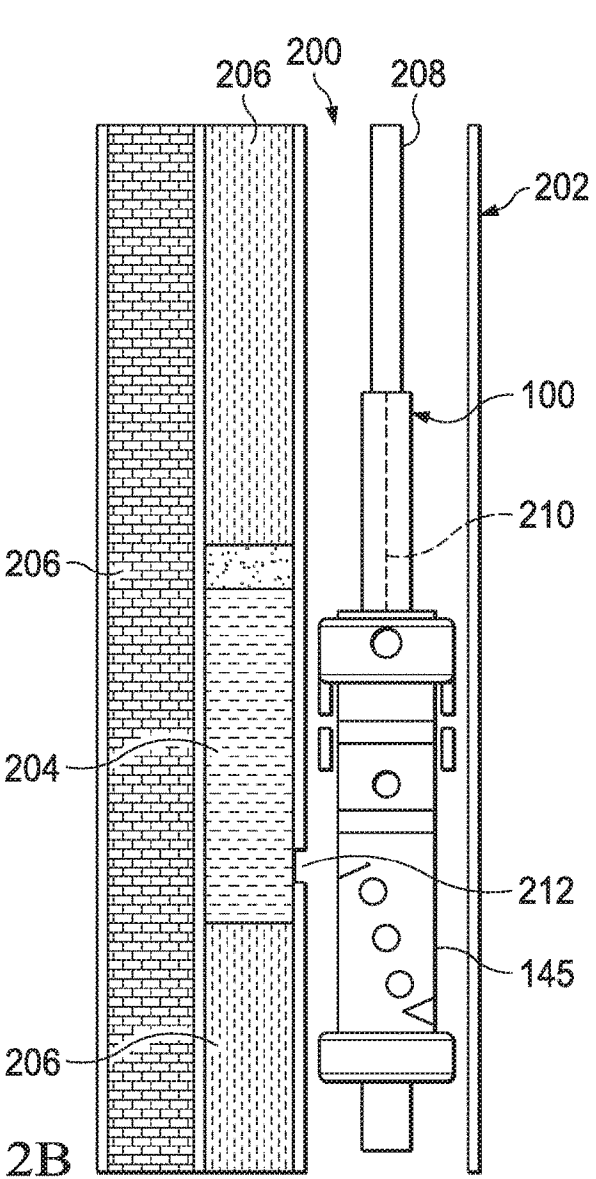
Figure 2A:
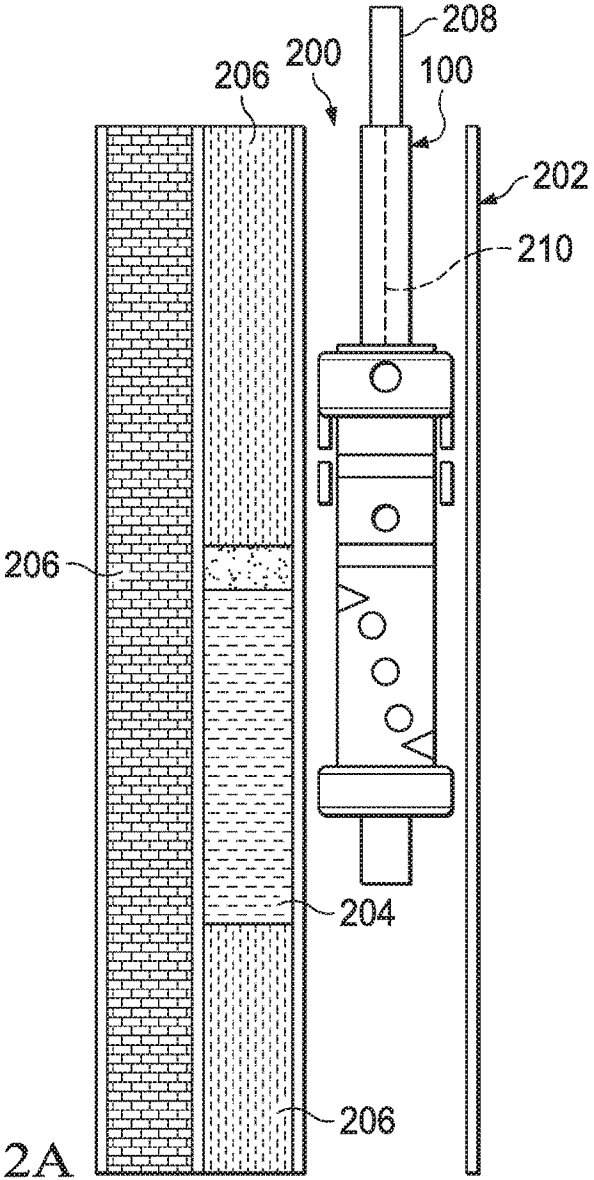
Figure 3B:
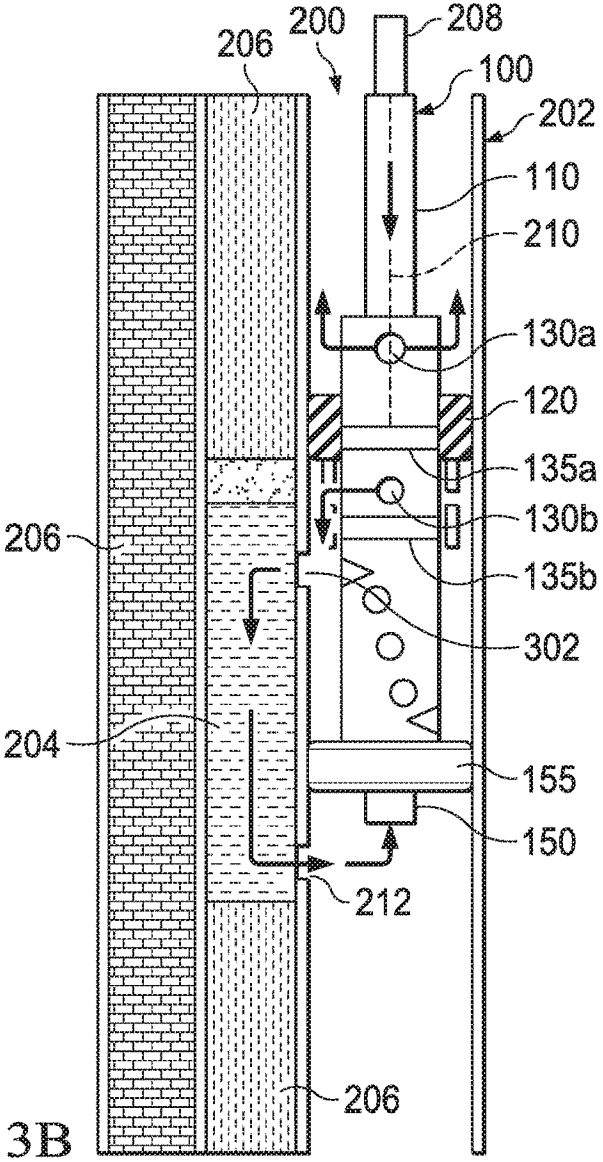
Figure 3A:
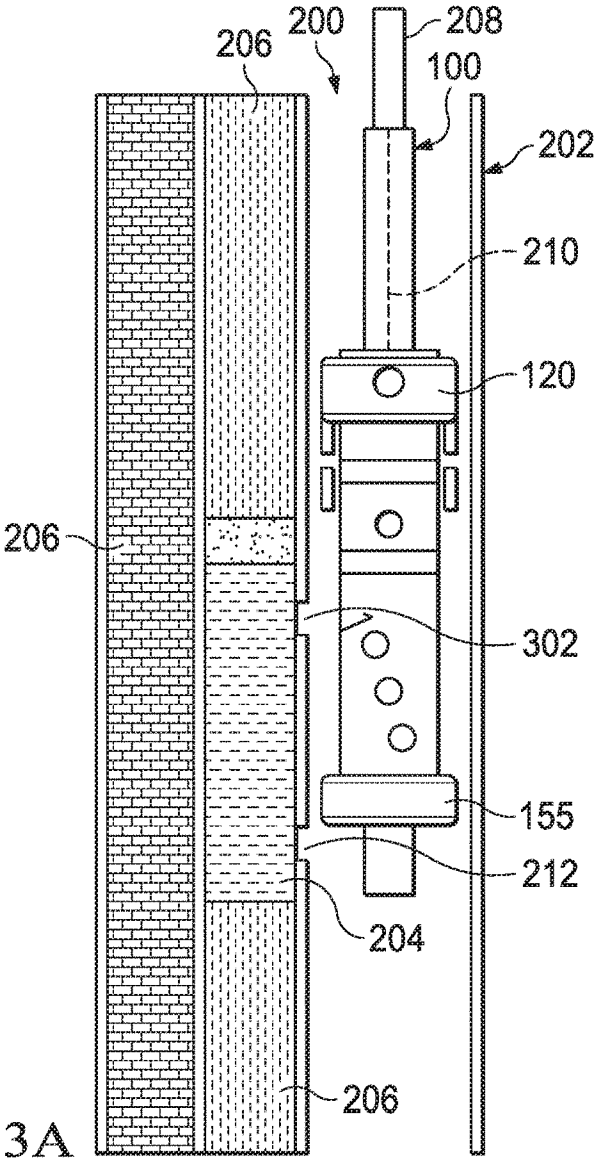
Figure 4B:
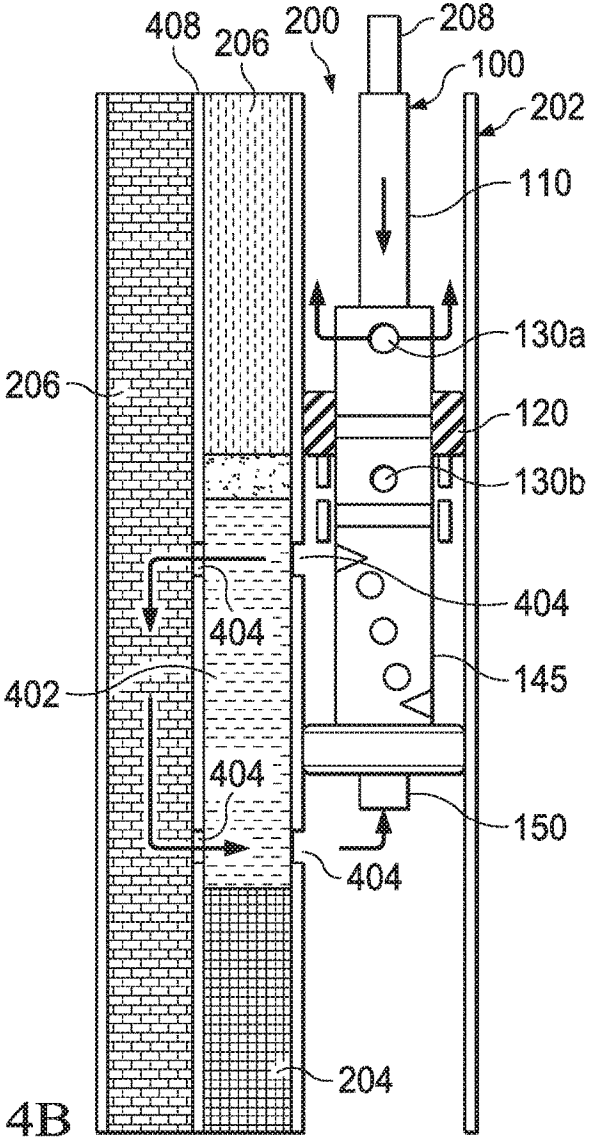
Figure 4A:
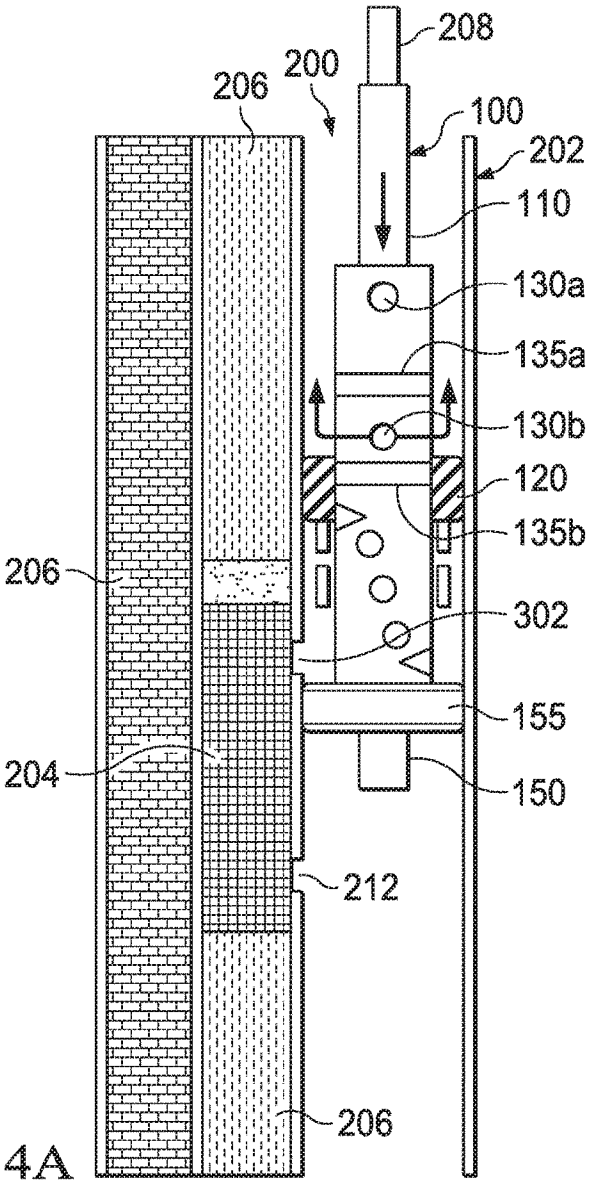
Figure 5:
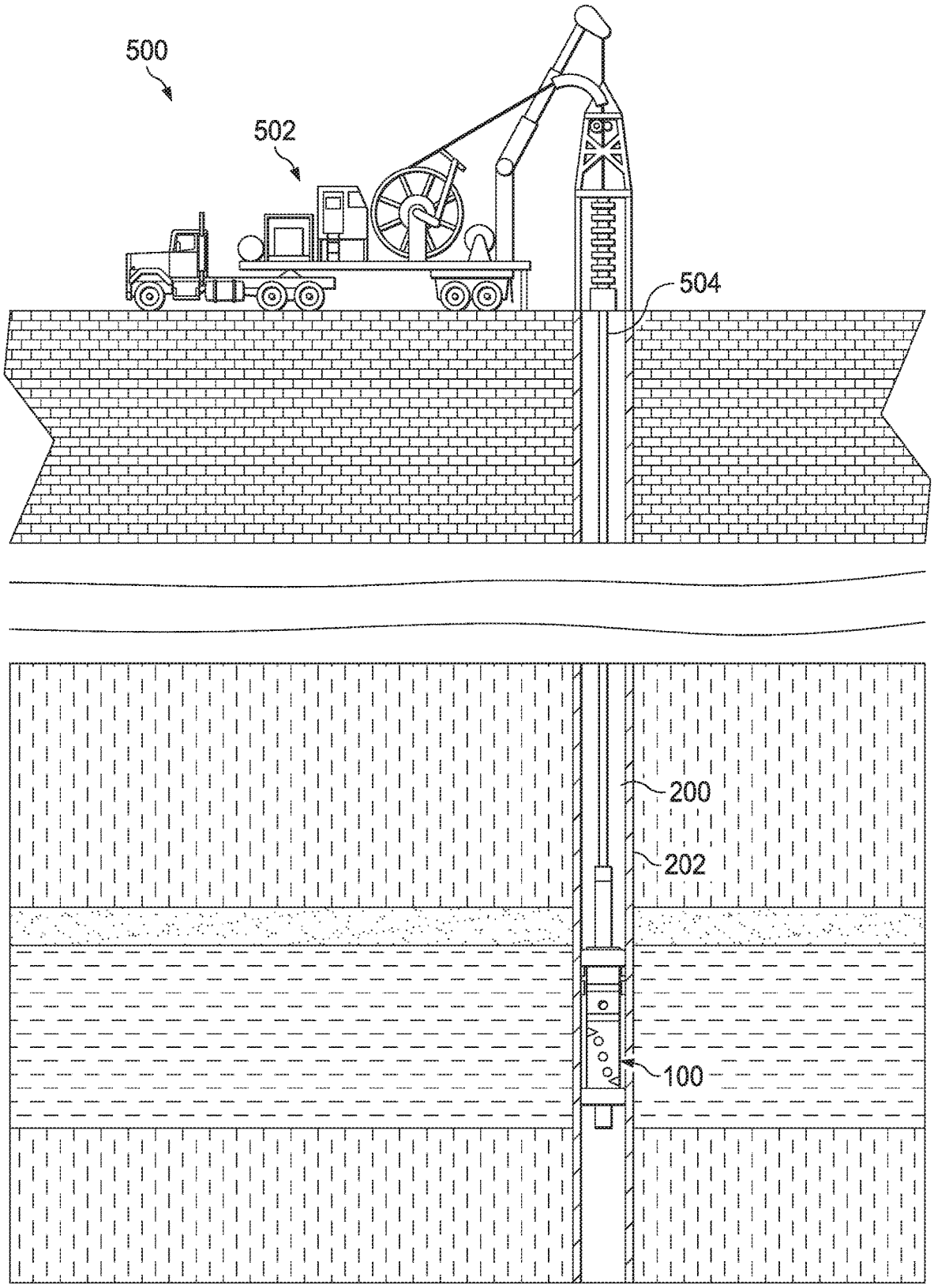

Reference is now made to the following descriptions taken in conjunction with the accompanying drawings, in which:

FIG. 1 schematically illustrates a single-trip tool;

FIG. 2A schematically illustrates a view of the single-trip tool being implemented in a run-in stage of a plugging process;

FIG. 2B schematically illustrates a view of the single-trip tool being implemented in a first perforation stage of a plugging process;

FIG. 3A schematically illustrates a view of the single-trip tool being implemented in a second perforation stage of a plugging process;

FIG. 3B schematically illustrates a view of the single-trip tool being implemented in plugging circulation stage of a plugging process;

FIG. 4A schematically illustrates a view of the single-trip tool being implemented in post-plugging cleanout circulation stage;

FIG. 4B schematically illustrates a view of the single-trip tool being implemented in a plugging process of a second plugging zone within a same wellbore as the plugging zone of FIG. 3B; and FIG. 5 schematically illustrates a view of a plugging system being implemented in a wellbore.

DETAILED DESCRIPTION

Currently an oil or gas well is plugged and abandoned (P&A) at the end of its useful productive life by placing cement barriers in the wellbore to prevent residual hydrocarbons from leaking to surface. This is usually achieved by removing an interval of tubular and replacing it by placing a cement plug in the wellbore. P&A, and especially slot recovery operations, require removal of old casing strings, either by section milling or by pulling the casing/tubing out of the well, which can prove difficult, problem-bound, and costly. Static friction has to be overcome in the first instance and the casing might become subsequently stuck by the settling of debris and barite in the annulus, which would then require multiple time-consuming cut and pull operations to remove the casing in smaller pieces.

Alternatively, an interval might be identified where the tubing annulus is sealed off by placing cement behind the tubing without having to remove the casing. It has been notoriously difficult to access successive casing strings, ensuring the entire annular cross-section is filled with cement and being able to accurately place cement that has properties that prevents shrinkage and ensures barrier longevity. Being able to successfully remove the annular fluid from multiple annuli, and replace the fluid with cement in one trip, without having to entirely cut and pull the casing, is clearly superior in terms of the reduction in the amount of time involved and the implied cost savings.

This disclosure, in its various embodiments, addresses the ability to access and set remedial cement in a subterranean oil and gas well by cementing casing annuli which are not directly accessible from the production casing. Additionally, it describes the method and means for isolating annular spaces behind multiple casing strings (B, C, D annuli) to prevent the migration of fluids, most notably hydrocarbons, to surface through microfractures and leak paths that might otherwise exist, by more accurately controlling the optimum placement of the cement barrier. The application of the various embodiments described herein are applicable for subsea intervention risers, riserless intervention (rigless or vessel), and/or slim hole casing design applications, where tool string dimensions are restricted to an OD smaller than the API drift of 7" casing, but can still maintain pressure integrity in multiple casing sizes.

This disclosure presents various embodiments of a new tool and methodology to work in a single-trip system and create conduits through the casing or tubing to access the annuli, circulate out the annuli contents, accurately deliver the cement required to create the subsequent barrier, and perform the pressure test to confirm there is no leak path through the new annulus cement plug. The tool and system provided by this disclosure provide a cost effective way of plugging an oil and gas well in a single trip without the need to remove in-place production casing, thereby saving time and cost associated with conventional methods and tool configurations.

In the drawings and descriptions that follow, like parts are typically marked throughout the specification and drawings with the same reference numerals, respectively. The drawn figures are not necessarily to scale. Certain features of this disclosure may be shown exaggerated in scale or in somewhat schematic form and some details of conventional elements may not be shown in the interest of clarity and conciseness. Specific embodiments are described in detail and are shown in the drawings, with the understanding that they serve as examples and that they do not limit the disclosure to only the illustrated embodiments. Moreover, it is fully recognized that the different teachings of the embodiments discussed, infra, may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements but include indirect interaction between the elements described, as well. In the following discussion and in the claims, the terms "including" and "comprising" are used in an open-ended fashion, and thus should be interpreted to mean "including, but not limited to." References to up or down are made for purposes of description with "up," "upper," or "uphole," meaning toward the surface of the wellbore and with "down," "lower," "downward," "downhole," or "downstream" meaning toward the terminal end of the well, regardless of the wellbore orientation. The term "zone" or "pay zone," as used herein, refers to separate parts of the wellbore designated for treatment or production and may refer to an entire hydrocarbon formation or separate portions of a single formation such as horizontally and/or vertically spaced portions of the same formation. The term "seat" as used herein may be referred to as a ball seat, but it is understood that seat may also refer to any type of catching or stopping device for an obturating member or other member sent through a work string fluid passage that comes to rest against a restriction in the passage. Further, any references to "first," "second," etc. do not specify a preferred order of method or importance, unless otherwise specifically stated but are intended to designate separate elements. The various characteristics mentioned above, as well as other features and characteristics described in more detail below, will be readily apparent to those skilled in the art with the aid of this disclosure upon reading the following detailed description of the embodiments, and by referring to the accompanying drawings.

FIG. 1 is a schematic illustration of an embodiment of a single-trip tool 100, as covered by this disclosure. The single-trip tool's 100 configuration provides a tool that allows for a single trip plug and abandonment operation of a subterranean wellbore without the need of removing in-place production casing or tubing and tripping out of the wellbore to change tools. In the illustrated embodiments, the single-trip tool 100 comprises a gravel pack-type assembly 110 that has a tubing mandrel 115 that extends the length of the single-trip tool 100. It should be noted that conventional gravel pack assemblies typically include a gravel pack screen that is used to create an annulus between the screen and the casing/open hole and hold the gravel in place during production. However, since the single-trip tool 100 is used to plug a well at the end of its production life, the gravel pack screen is not present in the gravel pack-type assembly 110. In certain embodiments, the various tools that make up the single-trip tool 100 may be of conventional design, but the tool is unique in its configuration in that its configuration provides for a single trip plugging activity for multiple zones.

The single-trip tool also includes a well packer 120. The well packer 120 may be of conventional design. For example it may be an external casing packer, an inflatable, or an expandable packer. Thus, in some embodiments, the packer includes packer seals, a packer housing, an anchoring mechanism, such as slips etc. The well packer 120 is coupled to the gravel pack-type assembly 110. The gravel pack-type assembly 110 comprises an upper extension 125 to provide a flow path from the uphole tubing above the packer 120 and to a casing annulus below the packer 120, when the packer 120 is in a set position. In one embodiment, the upper extension 125 includes upper flow port 130*a* and lower flow port 130*b* (for the plugging fluids), upper bore seal 135*a* and lower bore seal 135*b*. These seals 135*a*, 135*b* are sized to match the outer diameter of the upper extension 125 and the interior bore of the packer 120, and lower extensions 140 to house the gravel pack crossover tool throughout its range of motion. The length of the upper extensions 125 and 140 are designed to work with a particular packer and crossover tool and are typically available in two types, perforated and sliding sleeve. Additionally, the single-trip tool 100 includes a perforating device 145 located downhole from the packer 120, such as a perforating gun or other conventional device, that is able to puncture a wellbore casing to allow a plugging material to enter into a targeted zone.

In certain embodiments, the gravel pack-type assembly 110 includes a wash pipe 150. During operation, the wash pipe 150 is run below the packer 120 to ensure a return circulation path for the plugging material and other circulation or cleanout fluids used during the plugging operation. The wash pipe 150 provides an uphole circulation path through the gravel pack-type assembly 110 for the plugging material and other circulation fluids. In another embodiment, the single-trip tool 100 may further comprise a second packer 155, as referred to as a sump packer, that has sealing elements (not shown) associated therewith and that is located on the lower end of the single-trip tool 100. The second packer 155, an example of which may be a sump packer, may be set simultaneously or separately from the packer 120 to isolate a plugging zone. As used herein and in the claims, a "plugging zone" is a zone that is to be plugged during the P&A operation. In other embodiments, in place of a second packer 155, a retrievable bridge plug may be used, or some other device that can be used to cooperate with the packer 120 to isolate the plugging zone.

As noted above, the single-trip tool 100, as generally shown in FIG. 1, comprises a packer assembly. In one embodiment, the packer assembly may be of conventional design and comprise a retrievable primary packer, in that it can be set and reset multiple times without tripping out of the wellbore. As known to those skilled in the art, annular packers may be pneumatically or hydraulically expandable in that they may be swellable by means of a fluid, or they may be expanded by means of fluid diffusion or inflated by other means. The packer assembly can be positioned within a wellbore by conventional means to assure proper location of the packer above the plugging zone.

The primary packer comprises a packer body, a primary packing seal, a plurality of expandable slips, and a setting mechanism. In one embodiment, the packer body may comprise a toroid having a minimum inside diameter (packer bore) and a maximum outside diameter that allows it to transverse the cased wellbore when in a non-set position. In one embodiment, the outside diameter is seven inches or less, which makes it suitable for slim hole applications. However, one skilled in the art will recognize that it could be used in wells with larger diameters. The primary packing seal is located radially about the circumference of the packer body, and a plurality of expandable setting slips are distributed equally about the circumference of the packer body.

The primary packer may also comprise an attachment collar, to which a coil tubing or other workover string may be attached, a circulation port, a closing sleeve, and a lower production tubing that mechanically engages the sump packer (FIG. 1), which may also be of conventional design. The circulation port and closing sleeve cooperate to form a first selectively openable, closing sleeve valve that is connected in the packer assembly below the primary packer and above the plugging zone. The slidable closing sleeve, in one embodiment, may be of conventional design and selectively engageable by a shifting profile to operate the closing sleeve valve. The closing sleeve operates to open or close the circulation port in the tubing to effect the desired flow of the plugging material or slurry.

A conventional packer setting assembly may also be implemented in the embodiments of this disclosure to set the packer. In one embodiment, the setting tool may include setting ports, packer setting tubing, upper packer setting seals, lower packer setting seals, and a tool bottom plug.

The packer setting tool may be removably coupled to the primary packer assembly through disengageable lugs. The packer setting tubing is constructed of tubing of sufficient strength to contain hydraulic pressure, which will be used to set the primary packer and the above-mentioned, optional sump packer 155 (FIG. 1). The packer setting tubing may further comprise a ball valve seat and a shear pin.

In one embodiment, the packer setting assembly is a hydraulic setting tool. In such embodiments, the hydraulic setting tool is a hydraulic piston that generates the force required to set the primary packer and the optional sump packer 155.

In this particular embodiment, the hydraulic setting tool is used to shear setting pins, which drive the collet wedge into the upper slips outward as the setting piston moves upward. In turn, the piston cylinder and bottom wedge drives the lower slips outward by moving downward under the lower slips. By applying additional pressure to the setting tool, the final setting shear pins are sheared allowing the setting piston to move up compressing the packing elements and completing setting of the packer. The setting force is maintained by the internal slips, which allow the setting piston to ratchet upward but prevent the piston from moving downward when setting pressure is released. The packer is released when upward movement of the tubing shears the release pin. This allows the collet wedge to flex inward and the upper slips to retract. Subsequent upward movement opens up a pressure equalization bypass, relaxes the elements, and removes the bottom wedge from the lower slips. The packer can then be pulled uphole and re-set if there is a need to plug another zone.

The hydraulic setting tool is attached to the top of a crossover tool of the gravel pack assembly, discussed below, and has a sleeve shouldered against the setting sleeve of the primary packer. The setting ball is dropped to the ball seat in the crossover tool to plug off the ID of the work string. Applied pressure to the work string acts on a piston in the hydraulic setting tool to force the sleeve down to compress the slips and packing element of the packer. Special versions of the setting tool are available, which allow for rotation and high-circulating rates while running the gravel-pack assembly.

The gravel pack assembly, which in one embodiment may be of conventional design comprises a pack-off conduit, a seal, a latch mechanism, and a wash pipe assembly. The pack-off conduit is coupled to the uphole end of the primary packer through the latch mechanism, such as a threaded collet, which engages the attachment collar at the uphole end of the primary packer. The maximum outer diameter of the pack-off conduit is greater than the inside diameter of the primary packer. Thus, the pack-off conduit is prevented from passing through the primary packer. However, the outer diameter of the wash pipe assembly is less than the inside diameter of the primary packer and is also less than the inside diameter of the pack-off conduit. Thus, the wash pipe assembly is able to pass through both the pack-off conduit and the primary packer. The wash pipe assembly is removably coupled to the pack-off conduit.

In one embodiment, the wash pipe assembly comprises dual concentric wash pipes, an outer wash pipe and an inner wash pipe. The outer wash pipe and inner wash pipe are mechanically joined near their upper ends by a shear pin so that the inner and outer wash pipes move as a single unit until the pin is sheared. The outer wash pipe further comprises an outer wash pipe port near its upper end. In one embodiment, the outer wash pipe includes an outer wash pipe ball check valve held in the closed position by gravity and the inner wash pipe includes an inner wash pipe ball check valve held in the closed position by a fluted member and a spring. The inner wash pipe further comprises a gravel pack cross over conduit.

Generally, the gravel pack crossover portion of the gravel pack assembly creates the various circulating paths for fluid flow during gravel packing. The crossover portion consists of a series of molded seals surrounding a gravel pack port midway down the tool and a return port near the top of the tool. A concentric tube (washpipe) design in the crossover tool along with the gravel-pack packer and gravel-pack extension allow fluid pumped down the work string above the packer to "cross over" to the annulus below the packer. Similarly, return fluids flowing up the washpipe and below the packer can "cross over" to the work string/casing annulus above the packer.

In one embodiment, the upper portion of the wash pipe assembly is a workover pipe or tubing and has an outer diameter less than the inside diameter of the pack-off conduit. The upper portion of the wash pipe assembly, also has an outer diameter less than the inside diameter of the packer. The seal is positioned about an inside diameter of the pack-off conduit, and engages the substantially mill finish on the outer surface of the drill pipe, inhibiting fluid flow between the drill pipe and the seal, as the wash pipe assembly is moved up or down through the pack-off conduit. Thus, the seal inhibits fluid flow when engaged against the moderately rough surface of the drill pipe 280. In one embodiment, the seal is an O-ring, perhaps made of rubber, NEOPRENE®, or other suitable material. In an alternative embodiment, the O-ring is assembled as a metal ring with rubber or other suitable material thereon to inhibit fluid flow. In yet another alternative embodiment, the metal O-ring is externally threaded so as to engage matching internal threads within a groove in the inside diameter of the pack-off conduit.

In yet another alternative embodiment, the seal comprises a plurality of seals spatially separated along a length of the pack-off conduit. One skilled in the art will recognize that several alternative forms of the seal may be readily conceived while remaining within the scope of this disclosure.

The wash pipe assembly further includes a plurality of upper gravel pack seals and lower gravel pack seals located about the outer surface of the tool above and below the gravel pack port. In one embodiment, the wash pipe assembly further includes a shifting profile that is coupled to the downhole end of the wash pipe assembly and that is engageable with the closing sleeves of the packer assembly.

As noted above, the single-trip tool 100 also comprises a perforating device 145, as generally described in the embodiment of FIG. 1. The perforating device 145 may be of conventional design, for example, it may be a device for delivering abrasive fluids that perforates the casing, or it may be a hydraulic device that punches a hole in the casing. In the illustrated embodiment, the perforating device 145 is a perforating gun that includes a carrier gun body made of a cylindrical sleeve having a plurality of radially reduced areas depicted as scallops or recesses. It is coupled to the gravel pack-type assembly 110 and the packer by threads. Radially aligned with each of the recesses is a respective one of a plurality of shaped charges. Each of the shaped charges includes an outer housing and a liner. Disposed between each housing and liner is a quantity of high explosive.

The shaped charges are retained within the carrier gun body by a charge holder, which includes an outer charge holder sleeve and an inner charge holder sleeve. In this configuration, outer charge holder sleeve supports the discharge ends of the shaped charges, while inner charge holder sleeve supports the initiation ends of the shaped charges. With shaped charges, the perforation penetration are typically proportional to the weight of the charge. Although the charge size has an effect on the performance, the shape of the liner, the internal standoff in the gun, and the overall design should be considered. In a through-tubing application in which the carriers are small, the charge size may vary from 2 to approximately 8 g. The smallest charges are used in 1 9/16- and 1 11/16-in. hollow carriers and the larger sizes are used in expendable strips. In hollow-carrier casing guns with diameters of 3 1/8 in. or larger, charge weights of more than 12 g are common (typically 22 to 37 g for 5-in.-diameter guns). Normally, the largest charges are used in the large expendable guns and casing guns in which the charges are more than 50 g.

Disposed within inner charge holder sleeve is a detonator cord, such as a Primacord, which is used to detonate the shaped charges. In the illustrated embodiment, the initiation ends of the shaped charges extend across the central longitudinal axis of perforating gun allowing detonator cord to connect to the high explosive within the shaped charges through an aperture defined at the apex of the housings of the shaped charges. The detonator cord extends through the single-trip tool and can be detonated from the surface by using a number of conventional mechanisms or methodologies.

Each of the shaped charges is longitudinally and radially aligned with one of the recesses in carrier gun body when perforating gun is fully assembled. In the illustrated embodiment, the shaped charges are arranged in a spiral pattern such that each of the shaped charge is disposed on its own level or height and is to be individually detonated so that only one shaped charge is fired at a time. It should be understood by those skilled in the art, however, that alternate arrangements of shaped charges may be used, including cluster type designs wherein more than one shaped charge is at the same level and is detonated at the same time.

Perforating guns typically include a plurality of secondary pressure generators that are formed as a component of or coating on certain of the shaped charges contained therein. In the illustrated embodiment, shaped charges may include secondary pressure generators. As such, the perforating gun has a 4 to 1 ratio of standard shaped charges to shaped charges of the present disclosure that include secondary pressure generators. Even though a particular ratio has been described and depicted, those skilled in the art should recognize that other ratios both greater than and less than 4 to 1 are also possible and considered within the scope of the present disclosure. For example, in certain implementations, a greater ratio such as a 10 to 1 ratio is desirable. In other implementations a 20 to 1 ratio, a 50 to 1 ratio and up to a 100 to 1 ratio may be desirable. Likewise, lesser ratios may also be desirable including, but not limited to, a 1 to 1 ratio, a 1 to 4 ratio, a 1 to 10 ratio, a 1 to 20 ratio, a 1 to 50, a 1 to 100 ratio as well as any other ratio between 100 to 1 and 1 to 100. In addition, in certain embodiments, it may be desirable for all of shaped charges to include secondary pressure generators.

The secondary pressure generators may be formed as all or a part of a charge case such as charge case including as a coating on the charge case, a liner such, or the explosive within a shaped charge. Preferably, the secondary pressure generators are formed from a reactive material such as a pyrophoric materials, a combustible material, a Mixed Rare Earth (MRE) alloy or the like including, but not limited to, zinc, aluminum, bismuth, tin, calcium, cerium, cesium, hafnium, iridium, lead, lithium, palladium, potassium, sodium, magnesium, titanium, zirconium, cobalt, chromium, iron, nickel, tantalum, depleted uranium, mischmetal or the like or combination, alloys, carbides or hydrides of these materials.

In certain embodiments, the secondary pressure generators may be formed from the above mentioned materials in various powdered metal blends. These powdered metals also may be mixed with oxidizers to form exothermic pyrotechnic compositions, such as thermites. The oxidizers may include, but are not limited to, boron(III) oxide, silicon(IV) oxide, chromium(III) oxide, manganese(IV) oxide, iron(III) oxide, iron(II, III) oxide, copper(II) oxide, lead(II, III, IV) oxide and the like. The thermites also may contain fluorine compounds as additives, such as Teflon. The thermites may include nanothermites in which the reacting constituents are nanoparticles.

FIG. 2A illustrates an initial stage of one embodiment of a methodology of using the single-trip tool 100, as described above, wherein the single-trip tool 100 is positioned within a wellbore 200 that is lined with a production casing 202 down to at least the plugging zone, 204 located between various subterranean strata 206. FIG. 2A illustrates the single-trip tool 100 being lowered into the casing 202 of the wellbore 200 by a coil tubing or workover sting 208, which in certain embodiments may be of conventional design. In certain embodiments, the single-trip tool 100 may include a conventional optical fiber 210 and sensors that aide an operator in positioning the single-trip tool 100 in the appropriate location adjacent the plugging zone.

FIG. 2B illustrates the single-trip tool 100 after reaching the plugging zone 204. The single-trip tool 100 is positioned near a lower or downhole end of the plugging zone 204, such that the perforating device 145 is positioned adjacent the downhole end of the plugging zone 204. The operator engaged the device to form a first set of one or more openings 212 in the casing 202. In those embodiments wherein the perforating device 145 is a perforating gun, the operator detonates a first of a plurality of charges to form the first set of one or more openings 212 in the casing 202. The openings 212 provide a path for the plugging material into the plugging zone 204.

FIG. 3A illustrates the single-trip tool 100 after being moved uphole, nearer the upper or uphole end of the plugging zone 204, such that the perforating device 145 is positioned adjacent the uphole end of the plugging zone 204. The operator engaged the perforating device 145 to form a second set of one or more openings 302 in the casing 202. Again, in those embodiments where the perforating device 145 is a perforating gun, the operator detonates a second set of charges to form a second set of one or more openings 302 in the casing 202. The openings 302 provide a path for the plugging material into the plugging zone 204. In other embodiments, the openings 302 may be formed first and the opening 212 may be formed after the formation of the openings 302.

As seen in FIG. 3B, following the formation of the openings 212 and 502 in the casing 202, the single-trip tool 100 is positioned so that packer 120 is located above the plugging zone 204, and the packer 155 is located above the downhole openings 212. The packing seals of the packers 120 and 155 are engaged against the interior wall of the casing 202 in a manner described above, which moves the upper seal 135*a* into the packer 120 housing, as shown, and seals the openings 302 off from the uphole and downhole portions of the wellbore 200. The gravel pack-type assembly 110 is stroked up so that the upper flow port 130*a* is free of the packer 120. Plugging material, such as lightweight cement, is circulated through the single-trip tool's 100 micro-annulus, and the cement is pumped down through the tool in a very precise manner to fill the casing annulus accurately, as per the fiber optic's 210 volume calculations. During this circulation, the plugging material is pumped through the lower flow port 130*b* and into the annulus, through uphole openings 302. The plugging material fills the plugging zone and flows out the downhole openings 212 and into the gravel pack-type assembly 110 by way of the wash pipe 150, as indicated by the arrows. Upon completion of the plugging process, the zone is pressure tested to make certain the zone is effectively plugged and sealed.

As shown in FIG. 4A, the gravel pack-type assembly 110 is stroked up again, which pulls the lower bore seal 135*b* into the seal bore of the packer's 120 housing and prevents circulation below the packer 120 to continue wellbore cleaning, post plugging operations.

In the event, other plugging zones are present in the wellbore 200, the same trip, meaning that the single-trip tool 100 does not have to be removed from the wellbore 200, can be used to plug these additional zones as well. For example, following the completion of plugging zone 204, the packers 120 and 155 are released from the interior sidewall of the casing 202, which enables the single-trip tool 100 to be moved uphole or downhole from the previous position to the next plugging zone. Once, the single-trip tool 100 is located adjacent the targeted plugging zone 402, the perforating device 145 is used in the same manner, as previously described to form uphole openings 404 and downhole openings 406 in the casings 202 and 408, in those instances of adjacent former production zones. The packers 120 and 155 are again set to isolate the zone, and the same plugging procedure, as previously described is repeated.

FIG. 5 illustrates a system 500 used to conduct the plugging operations as described above. In one embodiment, the system 100 comprises a workover rig or truck 502 that supplies a coiled tubing or workover string 504 to which the single-trip tool 100, as previously described, is attached. As mentioned above, the system may include a computer for controlling and monitoring the operations of the single-trip tool 100 during the plugging operations as previously described. The operator may use a conventional monitoring system to determine when the tool as reached the appropriate depth in the casing 202 of the wellbore 200. When the appropriate depth is reached, the perforating and plugging operations, as described above, are conducted on one or more plugging zones. Thus, the present disclosure presents embodiments of a single-trip tool and system that creates openings through the casing or tubing to access the annuli, circulate out the annuli contents, accurately deliver the plugging material required to create the subsequent barrier, and perform the pressure test to confirm there are no leak paths through the new annulus plug, without the need to trip out of the hole to change tools.

Embodiments disclosed herein comprise:

A method of plugging a wellbore in a single trip. The method of this embodiment comprises positioning a single-trip tool within a wellbore and at a first location adjacent a plugging zone of the wellbore with the single-trip tool comprising a packer, a gravel pack assembly, and a perforating device. This embodiment further comprises forming a set of downhole perforations in a casing of the wellbore with the perforating device at a first location adjacent the plugging zone. A set of uphole perforations are formed in the casing with the perforating device at a second location adjacent the plugging zone, A sealing element of the packer is set against an inner surface of the casing uphole the plugging zone. Plugging material is circulated through a flow port of the gravel pack assembly located downhole from the sealing element, into an annulus of the wellbore and through the set of uphole perforations and into the plugging zone and out of the plugging zone through the set of downhole perforations and uphole through a central fluid passageway of the gravel pack assembly and into the annulus uphole of the sealing element. The flow port is moved uphole from the sealing element and the plugging material is circulated through the flow port and into the wellbore uphole from the sealing element.

Another embodiment comprises a system for plugging a well in a single trip. This embodiment comprises attaching a single-trip tool to a tubing. The single-trip tool comprises a packer, a gravel pack assembly, and a perforating device. The single-trip tool is placed into a cased wellbore and is run downhole to a first location at a lower end of the plugging zone. A first set of perforations is formed in a casing of the cased wellbore at the first location with the perforating device. The single-trip tool is moved uphole to a second location of the plugging zone. A second set of perforations is formed in the casing at the second location with the perforating device. A sealing element of the packer is set against an inner surface of the casing. The single-trip tool remains at the second location, wherein the sealing element is located above the plugging zone. Annulus contents are circulated out of the wellbore from the plugging zone through a first flow port of the gravel pack assembly located downhole from the sealing element and into an annulus of the wellbore uphole of the sealing element through a second flow port. Plugging material is placed into the plugging zone by circulating the plugging material into an annulus of the wellbore downhole of the sealing element, through the first flow port and through the first set of perforations and into the plugging zone and out of the plugging zone through the second set of perforations. The plugging material circulates into a central fluid passageway tube of the gravel pack assembly and into the annulus uphole of the sealing element through the second flow port. The second flow port is moved uphole from the sealing element, and the plugging material is circulated through the second flow port and into the annulus uphole from the sealing element.

Another embodiment provides a single-trip tool system. The single-trip tool of this embodiment comprises a gravel pack assembly having a central fluid passageway and first and second spaced apart fluid valve ports located therein that are operable between closed and open positions. The gravel pack assembly further comprises first and second seals, wherein said first seal is located between said first and second fluid valve ports. This embodiment further comprises a packer assembly that has a packer housing and a seal bore located therein and a sealing element located on an outer perimeter of the packer housing. The packer assembly is coupled to the gravel pack assembly. A central passageway extends through the packer assembly and has a sealing element deploying mechanism associated therewith. This embodiment further comprises a perforating device coupled to the gravel pack assembly below the second fluid valve port. The second seal is located between the second fluid valve port and the perforating device.

Each of the foregoing embodiments may comprise one or more of the following additional elements singly or in combination, and neither the example embodiments or the following listed elements limit the disclosure, but are provided as examples of the various embodiments covered by the disclosure:

Element 1: wherein the flow port is a first flow port and the gravel pack assembly further comprises a second flow port located uphole from the first flow port and a seal located between the first and second flow ports, and comprising positioning the seal in a seal bore of a packer housing of the packer.

Element 2: wherein circulating comprises circulating the plugging material through the second flow port and into the annulus uphole from the sealing element.

Element 3: wherein the seal is a first seal and the gravel pack assembly further comprises a second seal located between the first flow port and the perforating device, and the method further comprising moving the first seal uphole from the sealing element and moving the second seal uphole and positioning the second seal concentric in the seal bore of the packer housing, and wherein the moving the first seal uphole positions the first flow port uphole from the sealing element.

Element 4: wherein the single-trip tool further comprises a wash pipe located downhole from the perforating device, and circulating comprises circulating the plugging material from the plugging zone and through the wash pipe and the second flow port.

Element 5: wherein the sealing element is a first packer sealing element and the single-trip tool further comprises a second packer having a second packer sealing element located between the perforating device and the wash pipe, and setting the first packer sealing element further comprises setting the second packer sealing element against an inner surface of the casing.

Element 6: wherein the plugging zone is a first plugging zone and the method further comprises moving the single-trip tool to at least a second plugging zone and repeating the forming downhole perforations, the forming uphole perforations, the setting, and the moving for each of the at least second plugging zone.

Element 7: attaching the single-trip tool to a tubing and positioning includes running the tubing and attached the single-trip tool to the plugging zone.

Element 8: wherein the gravel pack assembly further comprises a seal located between the first and second flow ports, the method further comprising positioning the seal in a seal bore of a packer housing of the sealing element of the packer.

Element 9: wherein the seal is a first seal and the gravel pack assembly further comprises a second seal located between the first flow port and the perforating device, and the method further comprising moving the first seal uphole from the sealing element of the packer and moving the second seal uphole and positioning the second seal in the seal bore of the packer, and wherein the moving the first seal uphole positions the first flow port uphole from the sealing element of the packer.

Element 10: wherein the single-trip tool further comprises a wash pipe located downhole from the perforating device, and circulating comprises circulating the plugging material from the plugging zone and through the wash pipe and the second flow port.

Element 11: wherein the sealing element of the packer is a first sealing element and the single-trip tool further comprises a second packer having a second sealing element located between the perforating device and the wash pipe, and setting the first sealing element further comprises setting the second sealing element against an inner surface of the casing.

Element 12: wherein the plugging zone is a first plugging zone and the method further comprises moving the single-trip tool to at least a second plugging zone and repeating the forming first and second sets of perforations, the setting, and the moving for each of the at least second plugging zone.

Element 13: wherein the gravel pack assembly further comprises a wash pipe section located below the perforating device.

Element 14: wherein the packer assembly is a first packer assembly and the single-trip tool further comprises a second packer assembly having a sealing element and coupled to the gravel pack assembly below the perforating device.

Element 15: wherein the packer assembly is an inflatable packer.

Element 16: wherein the perforating device further comprises a plurality of shaped charges located therein.

Element 17: further comprising coiled tubing having an optic sensor associated therewith and coupled to the single-trip tool.

The foregoing listed embodiments and elements do not limit the disclosure to just those listed above.

Those skilled in the art to which this application relates will appreciate that other and further additions, deletions, substitutions and modifications may be made to the described embodiments.

What is claimed is:

1. A method of plugging a wellbore in a single trip, comprising:

positioning a single-trip tool within a wellbore and at a first location adjacent a plugging zone of said wellbore, said single-trip tool comprising a packer, a gravel pack assembly, and a perforating device;

forming a set of downhole perforations and uphole perforations in a casing of said wellbore with said perforating device at a first location adjacent said plugging zone;

setting a first sealing element of said packer against an inner surface of said casing uphole of said uphole perforations and a second sealing element of said packer against said inner surface of said casing between said uphole perforations and said downhole perforations; and circulating a plugging material downhole through said gravel pack assembly, into an annulus of said wellbore and through one of said uphole perforations or downhole perforations and into said plugging zone, and out of said plugging zone through the other of said set of downhole perforations or uphole perforations and back uphole.

2. The method of claim 1, wherein circulating a plugging material, includes circulating the plugging material through a flow port of said gravel pack assembly located downhole from said first sealing element, into an annulus of said wellbore and through said uphole perforations and into said plugging zone and out of said plugging zone through said set of downhole perforations and uphole through a central fluid passageway of said gravel pack assembly and into said annulus uphole of said second sealing element.

3. The method of claim 2, further including moving said flow port uphole from said first sealing element and circulating said plugging material through said flow port and into said wellbore uphole from said second sealing element.

4. The method of claim 2, wherein said flow port is a first flow port and said gravel pack assembly further comprises a second flow port located uphole from said first flow port and a seal located between said first and second flow ports, said method further comprising positioning said seal in a seal bore of a packer housing of said packer.

5. The method of claim 4, wherein circulating comprises circulating said plugging material through said second flow port and into said annulus uphole from said second sealing element.

6. The method of claim 4, wherein said seal is a first seal and said gravel pack assembly further comprises a second seal located between said first flow port and said perforating device, and said method further comprising moving said first seal uphole from said first sealing element and moving said second seal uphole and positioning said second seal concentric in said seal bore of said packer housing, and wherein said moving said first seal uphole positions said first flow port uphole from said first sealing element.

7. The method of claim 4, wherein said single-trip tool further comprises a wash pipe located downhole from said perforating device, and circulating comprises circulating said plugging material from said plugging zone and through said wash pipe and said second flow port.

8. The method of claim 7, wherein said second sealing element is located between said perforating device and said wash pipe.

9. The method of claim 1, wherein said plugging zone is a first plugging zone and said method further comprises moving said single-trip tool to at least a second plugging zone and repeating said forming downhole perforations and uphole perforations, said setting, and said moving for each of said at least second plugging zone.

10. A single-trip tool system, comprising:

a gravel pack assembly having a central fluid passageway and first and second spaced apart fluid valve ports located therein, said first and second fluid valve ports being operable between closed and open positions to open and close access to said central fluid passageway, said gravel pack assembly further comprising first and second seals, wherein said first seal is located between said first and second fluid valve ports;

a first packer assembly having a packer housing and a seal bore located therein and a first sealing element located on an outer perimeter of said first packer assembly, said first packer assembly coupled to said gravel pack assembly, said central passageway extending through said first packer assembly and having a first sealing element deploying mechanism associated therewith;

a second packer assembly having a second sealing element located on an outer perimeter of said second packer assembly, said second packer assembly coupled to said gravel pack assembly, said central passageway extending through said second packer assembly and having a second sealing element deploying mechanism associated therewith; and a perforating device including a plurality of charges therein coupled to said gravel pack assembly below said second fluid valve port and between said first packer assembly and said second packer assembly, said second seal being located between said second fluid valve port and said perforating device.

11. The single-trip tool system of claim 10, wherein said gravel pack assembly further comprises a wash pipe section located below said perforating device.

12. The single-trip tool system of claim 10, wherein said packer assembly is an inflatable packer.

13. The single-trip tool system of claim 10, wherein said wherein said plurality of charges are a plurality of shaped charges.

14. The single-trip tool system as recited in claim 10, further comprising coiled tubing having an optic sensor associated therewith and coupled to said single-trip tool.

* * * * *